US005735413A

United States Patent [19]

Allen

[11] Patent Number: 5,735,413

[45] Date of Patent: Apr. 7, 1998

[54] STORAGE CADDY AND WORK STATION

[76] Inventor: Benigene Allen, 2337 Swanson Rd., Portage, Ind. 46368

[21] Appl. No.: 708,633

[22] Filed: Sep. 5, 1996

[51] Int. Cl.[6] ..... A47F 5/00

[52] U.S. Cl. ..... 211/107; 211/110; 211/133.4; 248/218.4; 248/230.8

[58] Field of Search ..... 211/107, 13, 126, 211/205, 131, 129, 110; 248/121, 218.4, 230.1, 230.8, 230.9

[56] References Cited

U.S. PATENT DOCUMENTS

| | | | |
|---|---|---|---|
| 1,113,781 | 10/1914 | Griffin | 248/230.8 |
| 3,101,849 | 8/1963 | Osborn | 211/131 X |
| 3,102,638 | 9/1963 | Saunders | 248/121 X |
| 3,664,624 | 5/1972 | Freegard | 248/218.4 |
| 3,958,351 | 5/1976 | Summey | 248/230.1 X |
| 3,966,052 | 6/1976 | Kraus | 211/129 X |
| 4,122,956 | 10/1978 | Hargrove | 211/131 |
| 4,325,529 | 4/1982 | Seebinger | 248/218.4 |
| 4,971,234 | 11/1990 | Hay | 211/131 X |
| 5,263,675 | 11/1993 | Roberts et al. | 211/107 X |
| 5,277,390 | 1/1994 | Olson et al. | 248/218.4 |

*Primary Examiner*—Robert W. Gibson, Jr.
*Attorney, Agent, or Firm*—Brett A. Schenck

[57] ABSTRACT

A storage caddy for a column having a main body mounted around the column. A tray is pivotally connected to the main body such that the tray can be pivotally moved forward to a position that is accessible to a user operating the machine and then moved back to a storage position. A control rod is pivotally connected between the tray and main body to position the tray so that it is in a fixed lateral orientation preferably in the direction facing the user during the pivotal movement of the tray. The mounting mechanism of the main body includes a strap secured to the main body and wrapped around the column of the machine. The main body further includes an adjusting mechanism for tightening the strap around the column comprising a pin rotatably mounted to the main body and a clip removably connected to the pin. The strap passes through the clip and is retained by the clip to allow it to wind around the pin thereby tightening the strap around the column. The storage caddy further includes a second tray detachably connected to a support arm which is pivotally connected to the main body. The first mentioned tray is also rotatably mounted on the support arm. An extension tray can be detachably connected to either tray for storing additional objects.

19 Claims, 7 Drawing Sheets

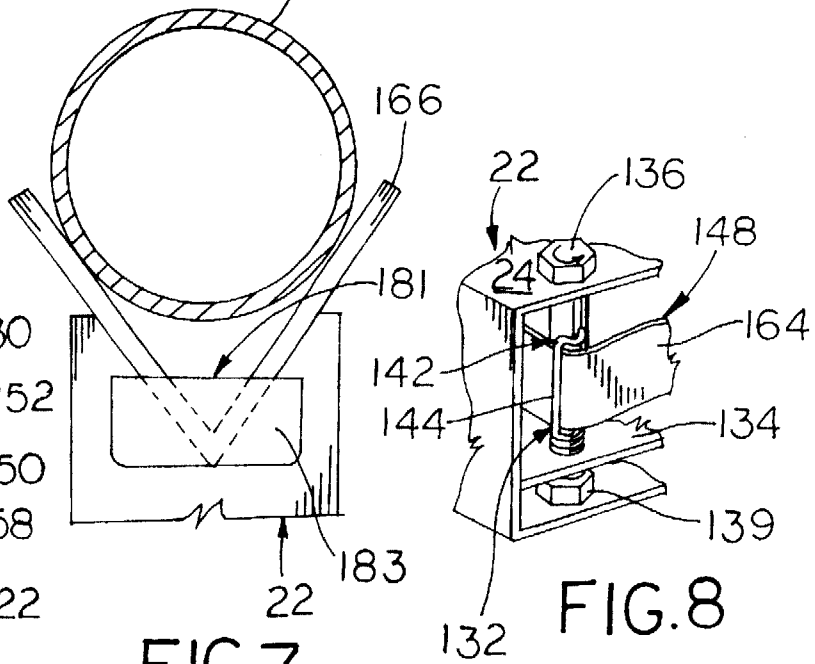
FIG.8
FIG.7
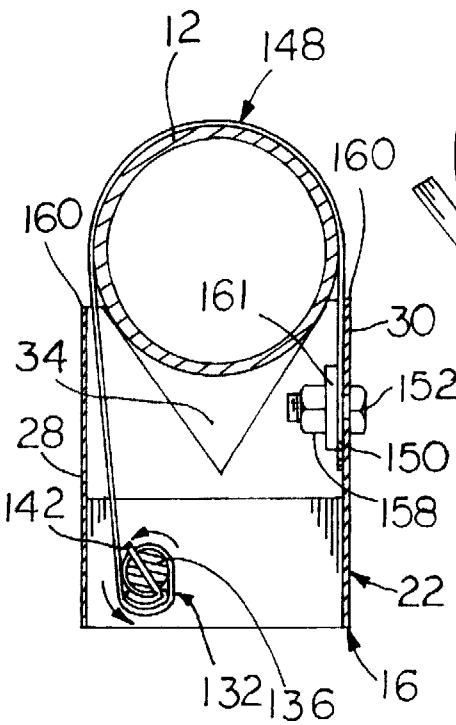
FIG.6
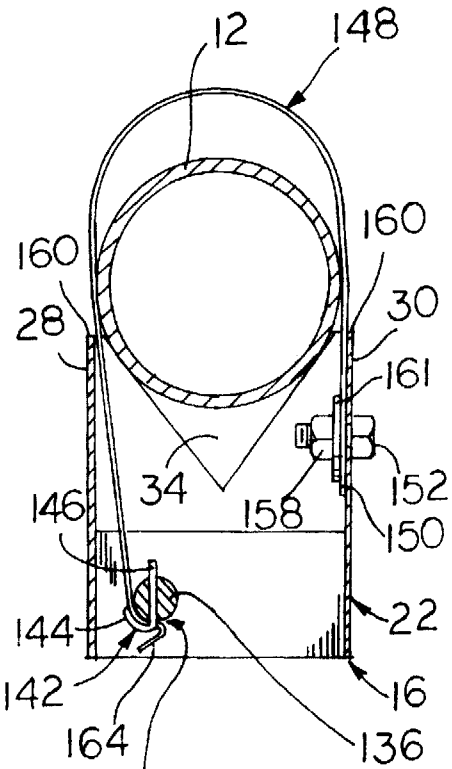
FIG.5

STORAGE CADDY AND WORK STATION

BACKGROUND OF THE INVENTION

The present invention relates to a storage caddy or work station. In particular but not limited to, this invention relates to a storage caddy for drill presses, milling presses, tapping machines and any device and machine that has a column for mounting the caddy thereto including columns in stores, shops and the like.

Regularly, operators for drill presses, milling presses, tapping machines and the like need tools such as drills, taps, dies, pins, washers and screws while they operate or repair the machine. Also,.the operators may need component parts for various types of production and machining jobs. However, the operator presently has to leave the work area to obtain these items. This process is inconvenient and time consuming, especially if the operator has to search for the items.

Accordingly, it is the object of the present invention to provide a caddy that can be mounted to machines that allows the operator to have an arms length access to tools and parts.

It is another object of the present invention to provide a caddy that can be mounted to columns for machines and stores which has trays that can be moved in various positions for easier access by the user.

Also, the columns which support these machines have different sizes at their cross sections. Moreover, in some cases, the columns may have different shapes at their cross sections.

Accordingly, it is an object of the present invention to provide a caddy that can be adjusted to mount to columns of various sizes and shapes for machines.

It is another object of the present invention to provide a caddy that can be quickly detached from a column and then reattached to another column.

It is still another object of the present invention to provide a caddy that can be adjusted to mount to columns of shops, storages and warehouses for storing and displaying various items.

SUMMARY OF THE INVENTION

In order to achieve these objectives, a storage caddy is provided for mounting to columns of various shapes and sizes for such machines and stores. In particular, the storage caddy includes a main body having a mechanism for removably mounting around the column. A support member is pivotally connected to the main body and extends away from the main body. A tray for storing items is rotatably connected to support member such that the tray can be pivotally moved forward to a position that is accessible to a user and then moved back to a storage position out of the way of the work area. A control rod is pivotally connected between the tray and main body to position the tray so that it is oriented at a fixed lateral angle with respect to a plane extending along the pivotal axis of the support member and column. This angle is preferably in the direction facing the user. In essence, the tray always faces the user during its pivotal and rotatable movement.

The mounting mechanism includes a strap secured to the main body and wrapped around the column. The mounting mechanism further includes an adjusting mechanism for tightening the strap around the column comprising a pin rotatably mounted to the main body and a clip removably connected to the pin. The strap passes through the clip and is retained by the clip to allow it to wind around the pin thereby tightening the strap around the column.

The storage caddy further includes a second tray for storing items detachably connected to a support arm which is pivotally connected to the main body. The first mentioned tray is also rotatably mounted on a separate support arm. An extension tray can be detachably connected to either tray for storing additional items.

BRIEF DESCRIPTION OF THE DRAWINGS

These and other features, aspects and advantages of the present invention will become understood with regard to the following description, appended claims, and accompany drawings where:

FIG. 5 is a sectional view of the mounting mechanism of the storage caddy being mounted around a column with the strap loosened;

FIG. 6 is a view similar to FIG. 5 except that the strap is tightened to secure the storage caddy to the column;

FIG. 7 is a top sectional view of the mounting mechanism with an angle adaptor mounted around a column;

FIG. 8 is a perspective view of a portion of the mounting mechanism of the storage caddy cut away illustrating the strap clip and pin combination.

DETAILED DESCRIPTION OF THE INVENTION

Figure 1:
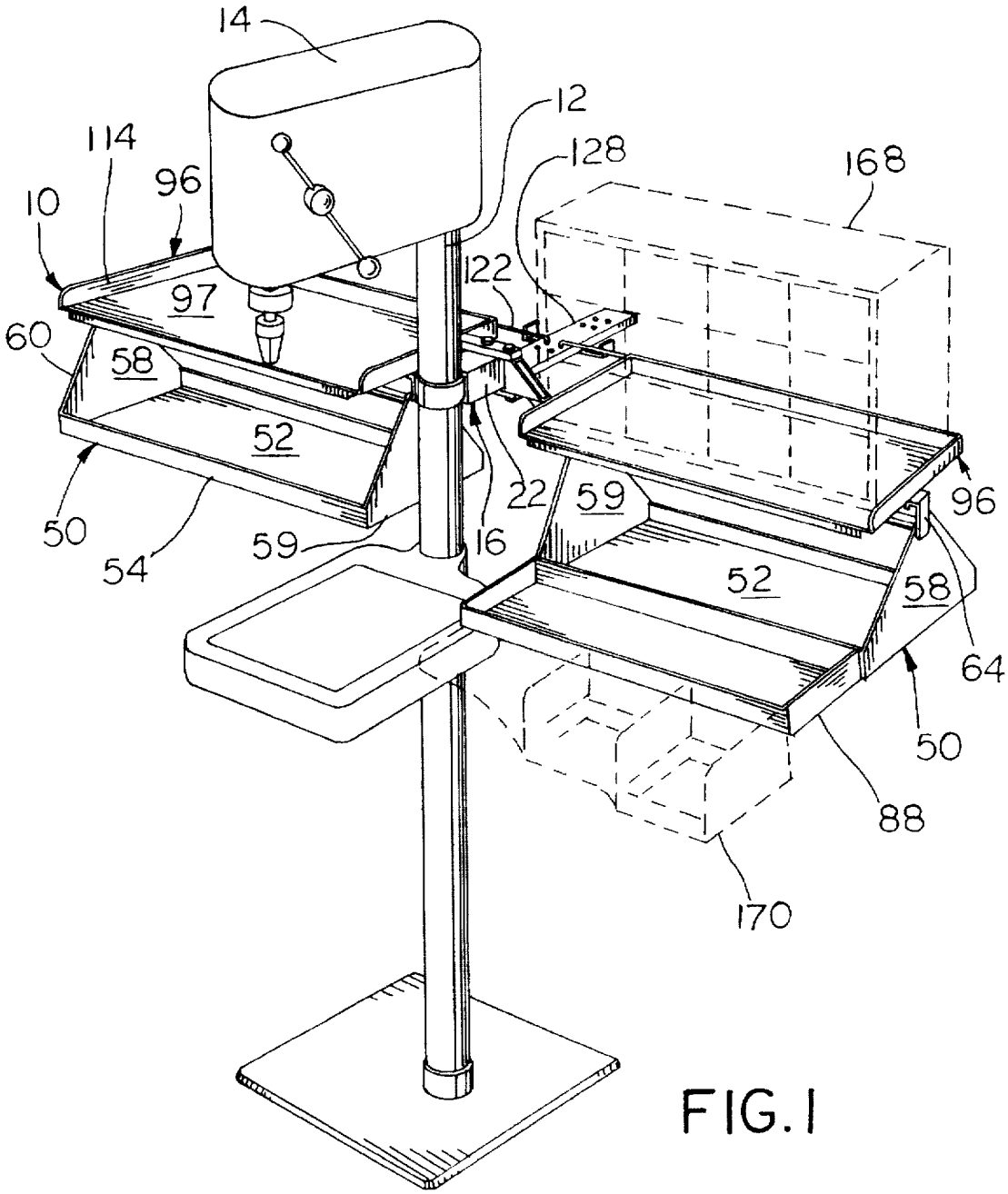
FIG. 1 is a front perspective view of the storage caddy mounted on the column of a drill press.
Figure 2:
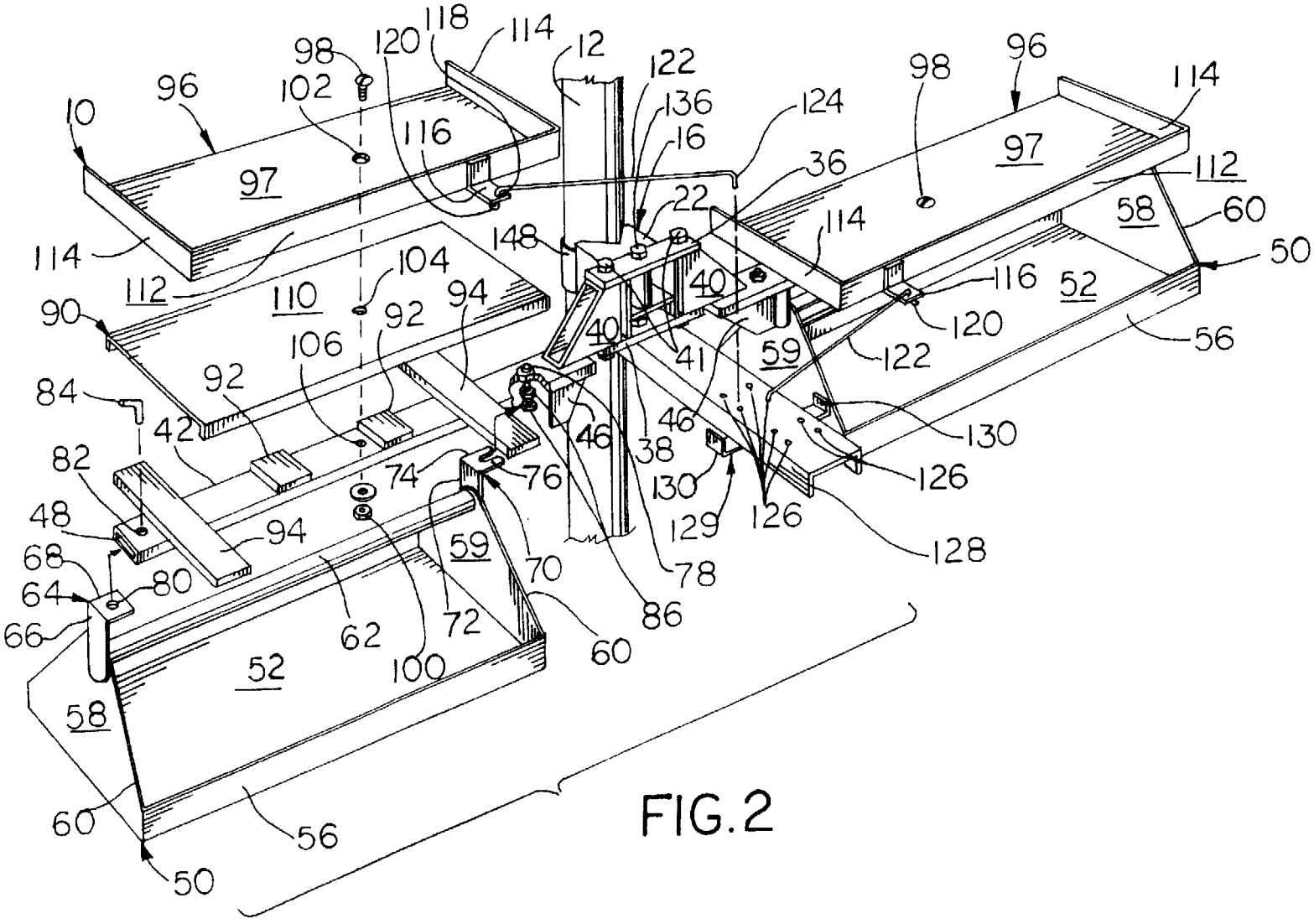
FIG. 2 is a rear exploded view of some of the components of the storage caddy.
Figure 3:
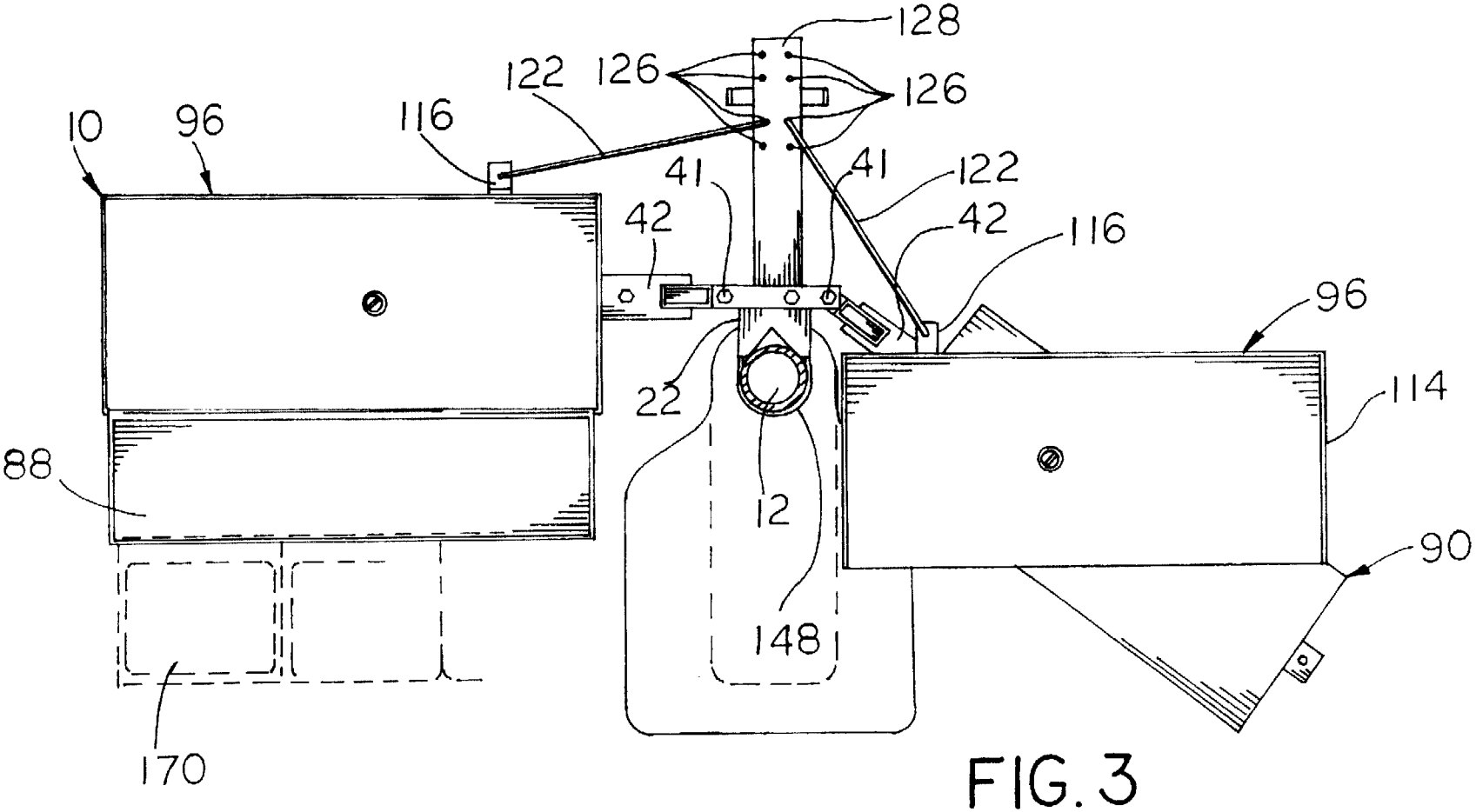
FIG. 3 is a top view of the storage caddy mounted on the column of a drill press.

Referring to FIGS. 1 through 3, the caddy 10 is shown mounted to the column 12 of a drill press 14. However, it should be noted that the caddy may be mounted to columns or posts of various sizes and shapes for other machines such as but not limited to milling presses, tapping machines, etc. or columns in stores, shops, warehouses and the like. The caddy 10 comprises a main body 16 mounted around the column 12, and upper and lower trays 96, 50 located on opposite sides of the main body 16 for storing items. As best depictd in FIG. 4, the main body 16 has a generally hollow bracket 22 defining a top wall 24, a bottom wall 26, and side walls 28, 30 with a rear opening 32 and a peripheral V-shaped front notch 34. The bracket 22 is sandwiched between an upper bar 36 and lower bar 38 at the rear end of the bracket 22.

As depicted in FIG. 2, a pair of hollow triangularly shaped wing members 40 are hingedly connected between the upper and lower bar members 36, 38 on opposite sides of the bar members by pivot pins or bolts 41 which extend through the bracket 22, upper and lower bars 36, 38, and wing members 40 at a slight angle from vertical. A lateral support arm 42 is welded securely to the bottom of each wing member 40 and extends outwardly from the wing member 40. Each support arm 42 has a shield part 46 depending downwardly from the rear side adjacent the innermost end of the arm 42. Each arm 42 is rectangular in shape and tubular having an opening or slot 48 at its outermost end. A lower tray 50 is detachably connected to each support arm 42. The lower tray 50 has a flat rectangular bottom wall 52, an upstanding front wall 54 (FIG. 1) and rear wall 56, and upstanding side walls 58, 59. The side walls 58, 59 have sloping edges 60 which converge upwardly and form a rounded corner at their apex. A handle 62 is attached between the side walls at their apexes.

The lower tray 50 further includes an outer L-shaped attachment 64 having a vertical base 66 attached to the outer side wall 58 of the lower tray 50 near the apex and a horizontal tongue 68 extending inwardly for insertion into the outer slot of 48 the support arm 42. The lower tray 50 further includes an inner L-shaped attachment 70 having a vertical base 72 attached to the inner side wall 59 of the tray 50 near the apex and a horizontal tongue 74 extending inwardly and having a U-shaped peripheral notch 76 for attachment to a stud 78, which is fastened to the support arm 42 by a nut and extends downwardly from the support arm 42. In particular, the horizontal tongue 68 of the outer attachment has an aperture 80 formed therein that is aligned with apertures 82 in the support arm 42 upon the horizontal tongue 68 being slidably inserted into the opening 48. An L-shaped locking pin 84 is inserted through the apertures 80, 82 to secure the tongue 68 to the arm 42. Also, at the same time, the stud 78 is slid into the notch 76 and secured thereto by a pair of jam nuts 86 sandwiching it. An extension tray 88 can be detachably hooked preferably onto the rear wall 56 (FIG. 1) or front wall 54 (FIG. 3) of the lower tray 50.

A support plate 90 is mounted upon each arm 42 with a pair of spacers 92 and support bars 94 sandwiched between the support plate 90 and arm 42 for additional strength, to prevent distortion to upper tray 96 and support plate 90 An upper tray 96 is rotatably mounted upon the support plate 90 by a screw 98 and nut 100 assembly in which the screw 98 passes through a countersunk hole 102 in the bottom wall 97 of the upper tray 96 and apertures 104, 106 in the support plate 90 and support arm 42, respectively. The upper surface 110 of the support plate 90 includes a low friction material disposed thereon to permit easier slideable rotation of the upper tray 96 on the support plate 90. The upper tray 96 also has upstanding rear and side walls 112, 114.

The support arm 42 swings or pivotally moves laterally forward and back thereby causing the lower and upper trays 50, 96 to be pivotally moved forward to a position that is accessible to a user and then moved back to a storage position away from the area used by the user. Additionally, an L-shaped coupling member 116 is mounted to the rear wall 112 of the upper tray 96 and includes an aperture 118 for receiving an end 120 of a control rod 122. The other end 124 of the control rod 122 extends downwardly and can be inserted into one of a series of apertures 126 arranged on a position arm 128 which is welded to the bottom wall 26 of the bracket 22 and extends rearwardly from the column 12.

Essentially, the control rod 122 controls the rotational movement of the upper tray 96 so that the tray 96 is oriented at a fixed lateral angle with respect to a plane extending along the pivotal axis of the support arm 42 and column 12 as shown in FIG. 3. Each aperture 126 corresponds to a different fixed lateral angle of the upper tray 96 as the upper tray 96 pivotally and rotatably moves forward and back. The end 120 of the control rod 122 for the aperture 118 in the coupling member 116 is curved generally in a Z-shaped pattern which allows a secure pivotal connection within the aperture 118 yet permits easy removal of the control rod 122 from the apertures 118 by the user. Therefore, a user can easily select the desired fixed lateral angle of the upper tray 96; for example, one in which the tray 96 generally directly faces the user during pivotal and rotatable movement of the upper tray 96 as depicted in FIG. 3. The position arm 128 also includes a stop member 129 (FIG. 2) having opposite ends 130 depending upwardly for preventing the lower tray 50 from hitting the position arm 128.

Figure 4:
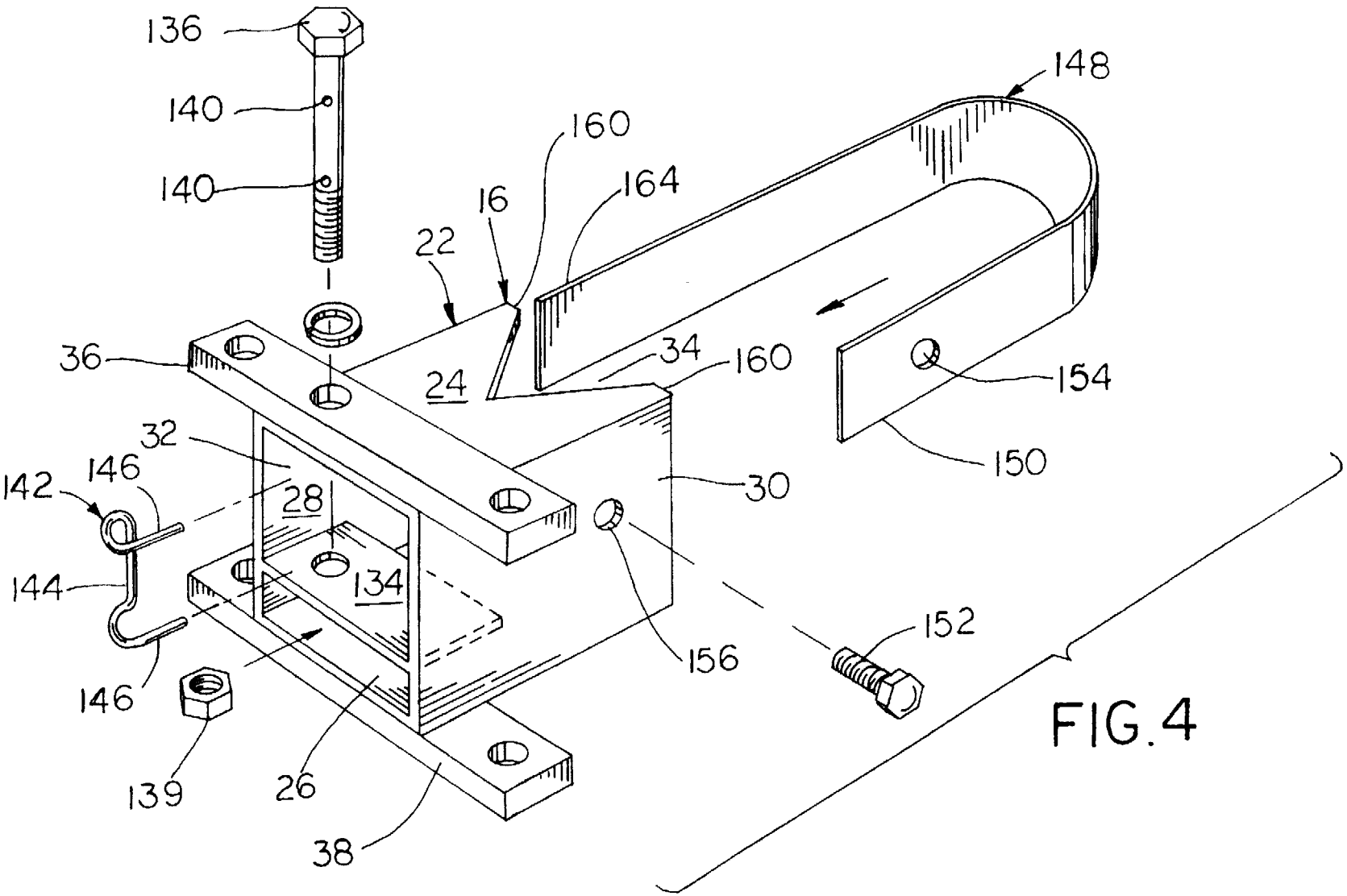
FIG. 4 is an exploded view of the mounting mechanism of the storage tray.

Referring to FIGS. 4–8, the main body 16 comprises the bracket 22 which also has a middle rectangular plate 134 attached between the side walls 28, 30 of the bracket 22 and located within the bracket 22 between the top and bottom walls 24, 26. The mounting mechanism 132 comprises a threaded bolt or pin 136 vertically disposed for rotational movement within apertures formed in the upper bar 36, top wall 24 and middle plate 134 and includes a jamb nut 139 turned on its distal end. As seen in FIG. 4, the bolt 136 has a pair of apertures 140 for receiving a retaining clip 142. The clip 142 has a body 144 which curves and terminates at each end into a pair of legs 146 that extend perpendicular from the body 144 such that when the legs 146 are inserted into the bolt apertures 140, an opening is created between the body 144 of the clip 142 and the bolt 136.

The mounting mechanism 132 further comprisies a flat adjustable strap 148 which is rectangular in shape and composed of a metal or other material that is flexible yet bendable. The strap 148 has one end 150 mounted to a side wall 30 of the bracket 22 by a screw 152 inserted through apertures 154, 156 in the strap 148 and side wall 30, respectively, with a nut 158 and washer 161 threadily fastened on the distal end of the screw 152. As depicted in FIG. 5, the column 12 is seated within the V-shaped notch 34 of the bracket 22 and the strap 148 is wrapped around the column 12 and retained by the clip 142 which is inserted into the bolt apertures 140. Each side of the notch 34 terminates into an offset edge 160 which creates a gap between the column 12 and side wall 28 or 30 of the bracket 22 to allow the strap 148 to easily pass therethrough. The other end 164 of the strap 148 passes through the opening between the bolt 136 and body 144 of the clip 142 (FIG. 8) and is bent slightly around the body 144 of the clip 142 so that the body 144 can engage the strap 148 as shown in FIG. 5.

Figure 9:
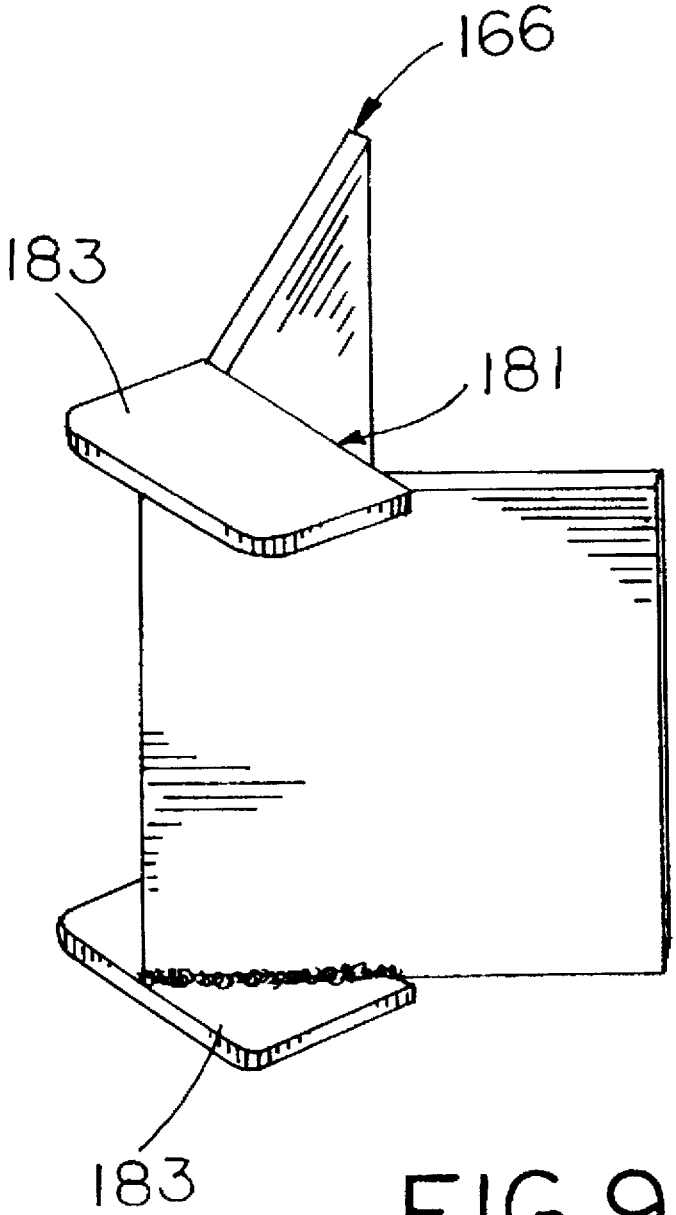
FIG. 9 is a perspective view of the angle adaptor and holding bracket.

As illustrated in FIG. 6, the strap 148 is tightened around the column 12 by rotating or turning the bolt 136 counter-clockwise (in the direction of the arrows) to urge the strap 148 to wind around the bolt 136. The jamb nut 139 (FIGS. 4 and 8) is turned on the distal end to lock the bolt 136. The caddy 10 is easily detached from the column 12 by simply removing the nut 139, rotating the bolt 136 clockwise to unwind the strap 148 from the bolt 136, unbending the strap end 164 from the body 144 of the clip 142 to disengage the strap end 164 from the clip 142 and then pulling the bracket 22 out away from the column 22 to separate the strap end 164 from the bracket 22. As depicted in FIGS. 7 and 9, a V-shaped adaptor 166 having a larger opening than the bracket notch 34 is inserted within the bracket notch 34 to accomodate a column 212 that has too large of a diameter or cross section to be securely seated within the bracket notch 34. The adaptor 166 is secured to the bracket 22 by a C-shaped holding bracket 181 having opposite projections 183 for securely receiving the bracket 22 and adaptor 166 inserted between the projections 183.

Figure 10:
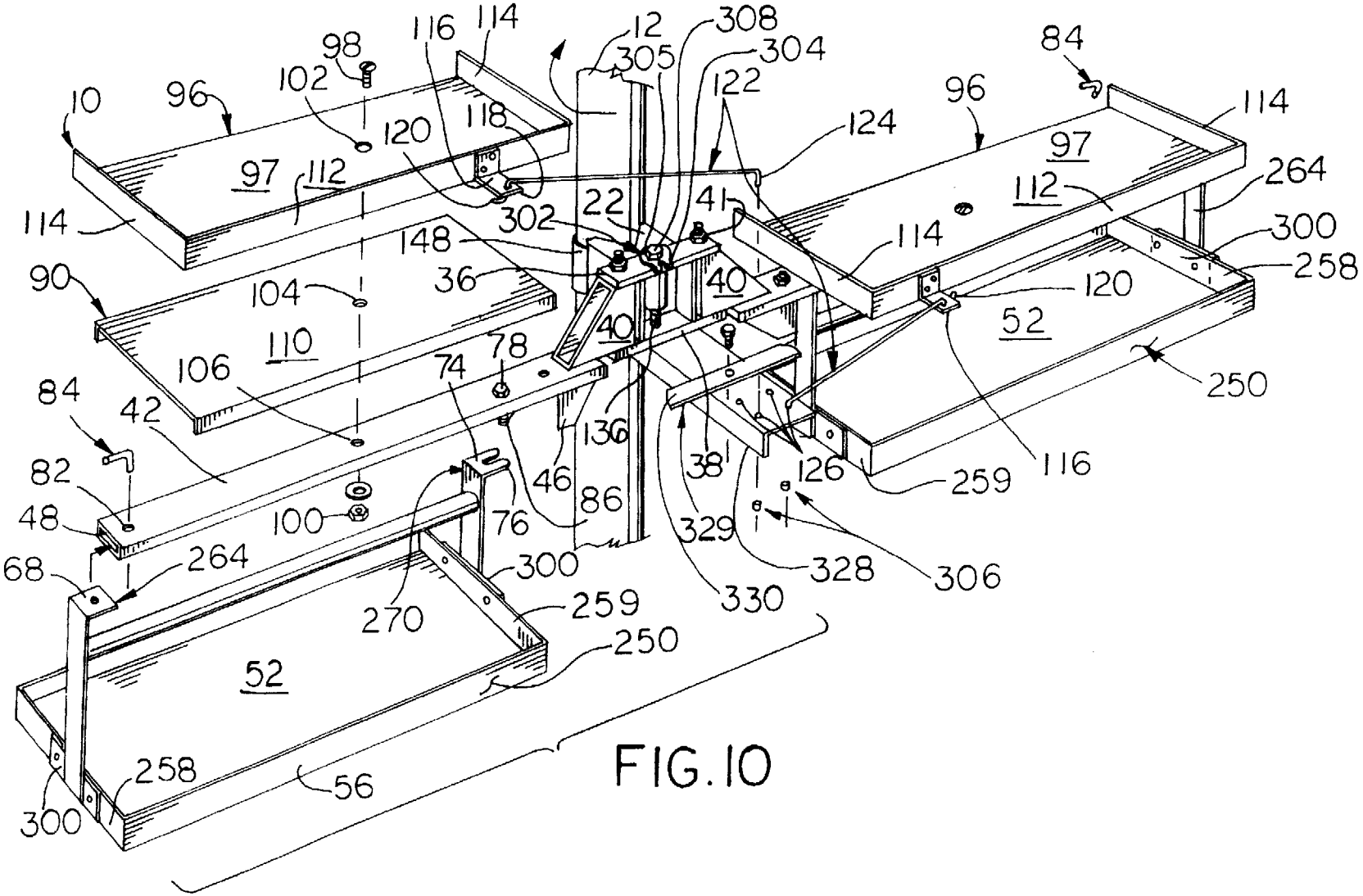
FIG. 10 is a rear exploded view of some of the components of another embodiment of the storage caddy.

FIG. 10 depicts another embodiment illustrating an alternative lower tray 250 in which the side walls 258, 259 are rectangular and shorter for better access from the sides and the outer atachment 264 and inner attachment 270 are lengthen and mounted to their respective side walls by mounting brackets 300. The stud 78 secures the inner attachment 270 with just one jam nut 86 and the arm 42 has no spacers or support bars mounted thereon. Also, the bracket 22 has no middle plate and the bolt 136 extends through a lock washer 302, and apertures in the upper bar 36 and top and bottom walls 24, 38 with the jamb nut 139 turned on its distal end. The washer 302 has a front portion 305 folded over the upper bar 36 and ears 304 folded over the flats of the head 308 of the bolt 136 to aid in preventing the bolt 136 from rotating when the bolt 136 is locked by the jam nut 139. Additionally, the control rods 122 include rubber keepers or stops 306 removably inserted on each end 124 of the control rods 122 to prevent the rod ends 124 from being removed from the apertures 126 of the position arm 328. Also, the stop member 329 has downwardly sloping beveled ends 330 with angled edges and is rotatably mounted on the position arm 328 which is shorter in length and has fewer apertures. Thus, the distance that the arm 42 and trays 250, 96 swing or pivot can be varied by rotating the stop member 329 to a selected position.

In operation, as shown in FIG. 3, the trays 50, 96 on one side of the caddy 10 can pivot or swing independently from the similar trays 50, 96 on the opposite side of the caddy 10 and thus can be in different positions. The upper trays 96 are strong enough to store heavy objects such as a box 168 containing shelves as indicated by the phantom lines in FIG. 1. Also, additional extension trays 170 indicated by the phantom lines in FIGS. 1 and 3 can be detachably connected to the first extension tray 88 or other trays. Furthermore, since the excess strap 148 is wound around the bolt 136, its perimeter with the bracket 22 can be adjusted in size to accomodate columns of various sizes as well as various shapes due to the strap's flexibility and bolt and clip assembly.

Additional changes and modifications to the embodiment of the invention as described herein can also be made, as will be apparent to those skilled in the art, while still remaining within the spirit and scope of the disclosed invention as set forth in the appended claims.

What is claimed is:

1. A storage caddy for a column comprising:

a main body having a mounting means for mounting said main body around said column; and a support member pivotally connected to said main body and extending away from said main body, a tray rotatably connected to said support member such that said tray can be pivotally moved forward to a position that is accessible to a user and then moved back to a storage position away from an area used by said user; and control means operatively associated with said tray for allowing rotation of said tray during the pivotal movement of said tray so that said tray is oriented at a fixed lateral angle with respect to a plane extending along the pivotal axis of the support member and column.

2. The storage caddy of claim 1 wherein said control means includes means for selecting a desired fixed lateral angle with respect to a plane extending along the pivotal axis of the support member and column for said tray during the pivotal movement of said tray.

3. The storage caddy of claim 2 wherein said control means includes a control rod detachably connected to said tray and said main body, said main body including a position arm secured thereto, said position arm having a plurality of apertures, each of said apertures for receiving said control rod to allow said tray to be at a fixed lateral angle with respect to a plane extending along the pivotal axis of the support member and column for said tray during the pivotal movement of said tray.

4. The storage caddy of claim 1 wherein said control means includes a control rod detachably connected to said tray and said main body.

5. The storage caddy of claim 4 wherein said control rod when detached permits said user to store said tray in a perpendicular orientation to said user.

6. The storage caddy of claim 1 wherein said support member includes a support arm pivotally connected to said main body, said tray being rotatably mounted upon said support arm.

7. The storage caddy of claim 6 wherein said support member includes a support plate mounted to said support arm, said tray being collectively rotatably and slideably mounted upon said support plate.

8. The storage caddy of claim 7 including a plurality of spacers positioned between the support plate and support arm to prevent distortion to said first tray and said support plate.

9. The storage caddy of claim 7 wherein said support plate has a low friction upper surface to allow said tray to slideably rotate freely.

10. The storage caddy of claim 1 including a second tray detachably connected to said support member.

11. The storage caddy of claim 10 wherein said support member includes a support arm pivotally connected to said main body, said second tray being detachably connected to said support arm.

12. The storage caddy of claim 1 including a second support member pivotally connected to said main body and extending away from said main body, a second tray rotatably connected to said second support member such that said second tray can be pivotally moved forward to a position that is accessible to a user and then moved back to a storage position away from an area used by said user; and second control means operatively associated with said second tray independent of said first tray for allowing rotation of said second tray during the pivotal movement of said second tray so that said second tray is oriented at a fixed lateral angle with respect to a plane extending along the pivotal axis of the support member and column.

13. The storage caddy of claim 10 including an extension tray detachably connected to said second tray.

14. The storage caddy of claim 10 including a support arm pivotally connected to said main body, said second tray includes a generally horizontal flat tongue for insertion into a slot formed at the distal end of said arm, said arm further having generally flat horizontal tongue having a peripheral notch for securely receiving a stud attached to said arm.

15. The storage caddy of claim 1 wherein said mounting means includes adjusting means for allowing said mounting means to mount said main body around at least a second column having different cross section.

16. A storage caddy for a column comprising:

a main body having mounting means for mounting said body around said column; said means for mounting includes a strap secured to said main body, said strap being wrapped around said column and further including adjusting means for tightening said strap around said column;

a tray pivotally connected to said main body such that said tray can be pivotally moved to a position that is accessible to a user and then moved back to a storage position away from an area used by the user.

17. The storage caddy of claim 16 wherein said adjusting means includes a pin rotatably mounted to said main body and a clip removably connected to said pin retaining said strap to said pin thereby allowing said strap to wind around said pin to tighten said strap around said column.

18. The storage caddy of claim 17 wherein said main body comprises a bracket, said pin being vertically disposed in said bracket, said bracket having a notch for receiving said column.

19. The storage caddy of claim 17 wherein said clip has a middle portion and a pair of leg portions extending from said middle portion, said pin has a pair of apertures for receiving said leg portions of said clip, said strap passing between said middle portion and said pin such that said middle portion engages said strap urging said strap to wind around said pin upon rotation of said pin.

* * * * *